United States Patent [19]

Kiening

[11] 4,370,408

[45] Jan. 25, 1983

[54] METHOD FOR REPAIRING SURFACE DEFECTS IN AN IMAGE OR PICTURE FILM

[76] Inventor: Hans Kiening, Hoehenbergweg 15, D-8170 Bad Toelz, Fed. Rep. of Germany

[21] Appl. No.: 278,082

[22] Filed: Jun. 29, 1981

[30] Foreign Application Priority Data

Jul. 9, 1980 [DE] Fed. Rep. of Germany ..... 3026029

[51] Int. Cl.[3] ..... G03C 5/24

[52] U.S. Cl. ..... 430/432; 430/463; 134/15; 352/56

[58] Field of Search ..... 430/432, 463, 401; 134/15; 352/56

[56] References Cited

U.S. PATENT DOCUMENTS

| | | | |
|---|---|---|---|
| 1,208,664 | 12/1916 | Russak et al. | 352/56 |
| 1,380,279 | 5/1921 | Wescott | 134/15 |
| 2,073,082 | 3/1937 | Sandvik | 179/100.3 |
| 2,920,960 | 1/1960 | Bushell | 134/15 |

FOREIGN PATENT DOCUMENTS

| | | | |
|---|---|---|---|
| 553438 | 5/1943 | United Kingdom | 352/56 |
| 931653 | 7/1963 | United Kingdom | 134/15 |

OTHER PUBLICATIONS

Crabtree et al, "Cleaning Liquids for Motion Picture Film", Trans. of SMPTE, Aug. 1927, pp. 277–293.

Turner et al, "A Machine for Cleaning Motion Picture Film", Journal of SMPTE, Jul. 1958, vol. 67, pp. 480–485.

Fassett et al, "Practical Film Cleaning for Safety and Effectiveness," Journal of SMPTE, Sep. 1958, vol. 67, pp. 572–589.

Journal of the SMPTE, vol. 66, Oct. 1957, pp. 607 to 615.

Fernseh- und Kinotechnik, vol. 34, Nr. 2 (1980), pp. 60 to 65, (Television and Cinema Technique).

*Primary Examiner*—Mary F. Downey

*Attorney, Agent, or Firm*—W. G. Fasse; D. H. Kane, Jr.

[57] ABSTRACT

Picture or image films are repaired by spraying a repair liquid, such as perchloroethylene, onto the scratched surface of the film while the film is moving through a continuous or constant speed zone on its way to a utilization station. The repair layer has a thickness of a few microns, for example 2.5 microns.

5 Claims, No Drawings

METHOD FOR REPAIRING SURFACE DEFECTS IN AN IMAGE OR PICTURE FILM

CROSS-REFERENCE TO RELATED APPLICATION

The present invention corresponds to German Patent Application No. P 3,026,029.8, filed in the Federal Republic of Germany on July 9, 1980. The priority of the German filing date is hereby claimed.

BACKGROUND OF THE INVENTION

The invention relates to a method of repairing surface defects in image or picture films. More specifically, the invention relates to filling in depressions such as scratches in the surface of such films.

In connection with the copying of picture films it has been known for a long time that the copying or printing results may be improved by wetting the developed picture film to be copied. In one known method, the picture gate or window and its immediate surroundings are filled with liquid so that the picture film, and in the case of contact printing naturally also the raw film to be exposed, are completely surrounded by the liquid, please see (Journal of the SMPTE, Vol. 66 (October 1957) pp. 607–615; Television and Cinema Technique, (Fernseh- & Kino-Technik) Vol. 34 No. 2, (1980), pp. 60–65.

The major drawback of this known method is seen in that the film transports dirt particles and air bubbles into the liquid, especially the perforations move air bubbles into the liquid. Eliminating these problems takes expensive preventative measures and the threading of the picture film and, if applicable, of the raw film into the printing machine is made considerably more difficult. Disturbances are also caused by splices, especially when the picture film has been subjected to several glazing procedures.

In the second known method, the picture film is passed through between two felt pads which are dampened or moistened with the liquid (System Piclear). In practice, it has been shown that in this method of operation the deeper scratches on the film base or support side are not totally filled in, so that the scratches remain visible in the print or copy and that the felt pads must be constantly monitored since dirt particles cling to these felt pads and such dirt particles may in turn lead to scratches on the picture film.

Both known methods have a drawback in common, in that the drying of the picture film before its winding or coiling-up requires a considerable waste of time and money. Hot-air blowers and a considerably extended film run or path between the picture gate or window and the take-up reel or cassette are necessary so that a printer must be specially constructed for use as a so-called wet-copying or printing apparatus, in particular, an available or existing printer must be completely rebuilt for this wet printing purpose. Such a printer is then only suited for wet-copying or printing. Furthermore, the known wet-copying or printing methods cannot be used for dry-spliced picture film. As is known, for splicing picture films, there are the wet-splice method and the dry-splice method, whereby the dry-splice method is the only one suited for specific films, namely, those having a polyester film base. In the known wet-copying methods, the dry-spliced sections are totally or partially dissolved, so that the dry-spliced films cannot be wet-copied or printed. Since a machine suited for the known wet-copying or printing methods is only usable for wet-copying, a separate printer must be available for dry-spliced films.

A further common drawback of both known methods is seen in that the wetting of the film is suited only for a single film-run speed, which is relatively low due to the necessary drying time, which makes a change-over to variable speeds practically impossible.

OBJECTS OF THE INVENTION

In view of the above it is the aim of the invention to achieve the following objects singly or in combination:

to provide a film repair method for the removal of scratches or the like from the film, which method may be applied even in existing printers or copiers without impeding the threading or winding of the film;

to provide such a film repair method which makes it possible to utilize the same prior art machine for dry-spliced film and for wet copying; and to use a spraying device in a constant film speed location or zone of a prior art film copying or printing apparatus for performing the present film repair method.

SUMMARY OF THE INVENTION

According to the invention film surface defects in or on a moving, developed film, such as a master copy, are repaired by means of an optically clear liquid which is applied to the film prior to the actual copying or projecting step. For this purpose said liquid is sprayed onto the film at a point or zone along the film path through which the film runs with a constant or continuous speed, as compared to an intermittent feed advance, in such a predetermined quantity that the sprayed on liquid is sufficient to form a layer having a thickness of a few microns, preferably 1 to 5 microns.

The invention is based on the consideration that it is imperative to fill in the surface defects, so-called scratches or the like with the liquid, and to keep the defects filled until the film has passed through the picture gate or window. This filling in is naturally achieved when the film is entirely submerged, such as in the first-named prior art method, but in said prior art way large portions or sections of the film are unnecessarily wetted by the liquid. An explanation for the fact that the deep scratches remain visible, in the second known method in which the film is wetted by felt pads, may be explained according to the invention. The felt pads partially wipe the liquid out of the deep scratches again, so that these surface defects are not totally filled when they arrive in the picture gate or window.

Advantages of the invention are seen in that the picture film retains a liquid coating, due to the spraying of the liquid. The surface of the liquid coating lies free and due to its surface tension the liquid forms a smooth face or surface on the film. Moreover, it suffices to have a very thin layer or coating on the large surfaces of the undamaged portions of the film, from which the liquid may quickly evaporate, while the evaporation from the scratches, in contrast to the undamaged portions is substantially delayed. Therefore, the scratches are still filled in any case even in the picture gate. Simultaneously, a very small liquid quantity is required, so that no special measures are necessary for drying, as long as the film speed remains in the range under 1 m/s (meter per second).

DETAILED DESCRIPTION OF PREFERRED EXAMPLE EMBODIMENTS AND OF THE BEST MODE OF THE INVENTION

Spraying mechanisms which can spray a thin liquid coating in the order of a few microns in thickness in a reproducible manner are known, see for example U.S. Pat. No. 2,674,167 to Edwards filed Sept. 18, 1950. Preferably a spraying device is used which has reproducible adjustment features. By varying the setting, the variable speed of the picture film may be taken into account for achieving the desired thickness of the sprayed-on layer.

An advantage of the method according to the invention, which can hardly be overrated, arises from the spray adjustment possibilities. It is necessary to merely view the projected picture of a scratched picture film during the adjustment work for setting the variable speed of the picture film. This is so since the results of a setting change of the spray mechanism are immediately visible in the picture being viewed. If desired, a projection mechanism may naturally be added to a printer, at least for the setting of the spray mechanism.

The drying of the sprayed-on repair liquid on the picture film is greatly simplified due to the small volume of liquid that is needed to accomplish the present purposes. Additionally, the work room is hardly burdened by the vapors of the liquid so that relatively simple ventilation measures are adequate for the protection of the operators.

From the above mentioned SMPTE - Journal it has been known for a long time that the surface defects of a picture film occur mainly on the film base or support side because the emulsion side is left free or untouched in practically all film equipment, so that all forces to which the film is exposed during handling are therefore always applied to the film base or support side, for instance, in the horizontal plane in the picture gate and when the film turns around rollers or pulleys thereby necessarily causing scratches. Furthermore, scratches on the emulsion side usually reach into the pigment layer and such scratches are always visible, whether they are filled in with the liquid or not. In the previously known methods, the emulsion side must also be wetted.

The invention preferably avoids wetting the emulsion side of the film thereby taking into account the relative significance of scratches on the emulsion side and on the film base or support side of a picture film. Thus, by spraying the repair liquid only on the support or base side of the film, the required liquid volume is halved, so that the aforementioned advantages, of the method according to the invention, concerning the drying of the picture film and the burdening of the air in the room with liquid vapors are enhanced even more. Moreover, it has been shown, that coating only the film base or support side with liquid, eliminates the diminished contrast observed when both sides are wet, compared to dry copied or printed films. In other words, a contrast as good as that of dry-copying is achieved according to the invention. Further so-called Newton's Rings, which appear in contact printing when the emulsion sides contacting each other are both wet, are prevented by the present method. As already mentioned, a one-sided coating of the moving or running picture film with liquid is not possible in the known methods.

A further reduction of the liquid volume or quantity is achieved by spraying the repair liquid only on the image carrying surfaces of the film thereby avoiding spraying liquid on those film areas which carry the perforations. Spraying the perforation film zones is unnecessary and avoiding it has the advantage that no liquid passes through the perforation holes onto the guide rollers or even on the emulsion side of the film.

A number of liquids are known which can be utilized for the so-called wet-copying or printing and these are also suitable for the method according to the invention. Due to the small volume of liquid, many fluids not usable in the known methods are also suitable for the present method, for example, those that are difficult to remove, those that may attack the picture film or the backing of the raw, yet unexposed film, or those that constitute a health hazard if used in larger quantities. If one of these known liquids such as perchloroethylene is used, a practically usable thickness of the liquid coating of 2.5 microns results.

A conventional film printer or projector supplemented, as taught herein by a conventional spraying device is also suited for dry-spliced films in any event, because in contrast to the known methods, the mechanism to carry out the method according to the invention may be easily shut off. It is also possible, with the small volumes of fluid of the method according to the invention, to wet-copy or print dry-spliced film. One only has to make sure that the liquid used does not dissolve too quickly nor permanently the adhesive of the dry or pressure sensitive supporting film. Although the invention has been described with reference to specific example embodiments it is to be appreciated that it is intended to cover all modifications and equivalents within the scope of the appended claims.

What is claimed is:

1. A method for repairing surface defects such as depressions and scratches in picture films including a carrier film portion, comprising the steps of feed advancing the developed film to a utilization station, providing a continuous feed advance zone for the film upstream of said utilization station as viewed in the feed advance direction of the film, spraying a predetermined quantity of repair liquid onto the film surface at said continuous feed advance zone, and dosing said predetermined quantity of repair liquid so that it is sufficient to form a layer on the film which has a layer thickness of a few microns, preferably 1 to 5 microns, said layer thickness being sufficiently thin to assure a quick evaporation on any undamaged film surface portions while simultaneously providing such an accumulation of repair liquid in said depressions and scratches that evaporation from these depressions and scratches is substantially delayed.

2. The method of claim 1 wherein said repair liquid is sprayed onto the free surface of said carrier film portion.

3. The method of claim 1 or 2, wherein said repair liquid is sprayed on that portion of the picture film which carries an image information.

4. The method of claim 3, wherein said repair liquid is perchloroethylene.

5. The method of claim 4, wherein said layer thickness of said repair liquid is 2.5 microns.

* * * * *